US005700190A

United States Patent [19]

Johnson et al.

[11] Patent Number: 5,700,190

[45] Date of Patent: Dec. 23, 1997

[54] FLOWHOOD WORK STATION

[75] Inventors: Roy P. Johnson, Yacolt; Donald L. Wilkinson, Camus, both of Wash.

[73] Assignee: SEH America, Inc., Vancouver, Wash.

[21] Appl. No.: 704,268

[22] Filed: Aug. 28, 1996

[51] Int. Cl.[6] ..... B08B 15/02

[52] U.S. Cl. ..... 454/57; 454/58; 454/60; 454/187

[58] Field of Search ..... 454/56, 57, 58, 454/60, 61, 187

[56] References Cited

U.S. PATENT DOCUMENTS

| | | | |
|---|---|---|---|
| 3,944,405 | 3/1976 | Van Calsteren et al. | 454/57 |
| 4,723,480 | 2/1988 | Yagi et al. | 454/57 |
| 4,832,717 | 5/1989 | Peters | 454/57 X |
| 5,316,560 | 5/1994 | Krone-Schmidt et al. | 454/187 X |
| 5,522,767 | 6/1996 | Bertsche et al. | 454/57 X |
| 5,525,106 | 6/1996 | Iizuka et al. | 454/187 |
| 5,607,647 | 3/1997 | Kinkead | 454/187 X |

FOREIGN PATENT DOCUMENTS

| | | | |
|---|---|---|---|
| 61-282742 | 12/1986 | Japan | 454/187 |

*Primary Examiner*—Harold Joyce

*Attorney, Agent, or Firm*—Chernoff, Vilhauer, McClung & Stenzel, LLP

[57] ABSTRACT

A flowhood work station has an inspection chamber having a perforated inspection surface. An air filtration housing is in fluid communication with the perforated inspection surface. A blower is capable of directing air downwardly through the perforated inspection surface. A return air plenum is in fluid communication with the perforated inspection surface and with the air filtration housing. The return air plenum captures a substantial portion of the air passing through the perforated inspection surface and directs the air to the air filtration housing.

6 Claims, 3 Drawing Sheets

FLOWHOOD WORK STATION

BACKGROUND OF THE INVENTION

This invention relates to a flowhood work station with built-in air recirculation for use in a clean room.

Integrated circuits are manufactured on silicon wafers. Such circuits are extremely sensitive to small particles of dust, metal or other material on the silicon wafer. Accordingly, after processing, the silicon wafers are visually inspected for small particles on the surface of the silicon wafer. Flowhood work stations are used in connection with such inspections. Particle contamination on the surface of a silicon wafer during the inspection itself is a recurring problem. Particles may be generated by the operator performing the inspection or merely by the operator's presence at the flowhood work station, and thus contribute to wafer contamination.

One of the methods used to reduce particle generation and contamination is the use of laminar air flow designs and filtration systems. Laminar air flow provides a practical and efficient means of maintaining a low level of particle contamination within a controlled area so long as the laminar air flow remains substantially uniform in velocity and direction and all air flow entering the controlled area has been filtered. Laminar air flow is disturbed when the flowing air contacts anything, such as a desk or table, that obstructs the flow or deflects its direction. Any turbulence or eddy currents in the laminar air flow may increase the amount of airborne particles and thus contribute to particle contamination.

Typically, silicon wafers are inspected at a flowhood work station in a clean room. The clean room provides an air supply from ceiling-mounted air vents having filters. Air is exhausted from the clean room through perforations in the floor, thus inducing a vertical laminar flow of filtered air in the clean room. The flowhood work station provides another controlled area within the clean room having even fewer airborne particles, and typically provides a vertical laminar flow of filtered air down into an inspection chamber. The silicon wafer is inspected within the inspection chamber on a perforated inspection surface, such as a stainless steel grill, or a surface made from vertical rods. The vertical laminar air flow passes through the inspection chamber, through the perforations of the inspection surface, and then down through the floor perforations where it is collected by air ducts under the floor of the clean room.

One of the problems associated with the inspection of silicon wafers at conventional flowhood work stations is that occasionally particles emitted from the legs of the uniformed operator beneath the inspection surface migrate through the perforated inspection surface and back up into the inspection chamber. Such particles are sources of contamination to the exposed silicon wafer. Another source of contamination is caused by air turbulence at the interface of the inspection chamber and the clean room resulting from deflection by the inspection surface or by items in the inspection chamber toward the operator, and then being pulled back into the inspection chamber by the low pressure created by the laminar air flow.

The design of a conventional flowhood work station also has an adverse effect on the clean room air flow in the proximity of the work station. Air enters the top of the flowhood work station, creating a zone of low pressure in the neighborhood of the top of the flowhood work station. This creates turbulence in the clean room which disturbs the vertical laminar air flow in the neighborhood of the flowhood work station. Such turbulence also leads to increased particle contamination in the clean room, and thus in the inspection chamber.

What is therefore needed is a flowhood work station that provides for vertical laminar air flow in the inspection chamber that reduces the migration of particles from an operator through the bottom of the perforated inspection surface into the inspection chamber, that reduces turbulence at the interface of the clean room and the inspection chamber, and that facilitates vertical laminar air flow in the clean room without turbulence caused by the intake of air from the top of the flowhood work station. These needs are met by the present invention, which is summarized and described in detail below.

SUMMARY OF THE INVENTION

The present invention overcomes the foregoing shortcomings of conventional flowhood work stations by providing a flowhood work station that has an inspection chamber having a perforated inspection surface, an air filtration housing in fluid communication with the perforated inspection surface, a return air plenum in fluid communication with the perforated inspection surface and with the air filtration housing, wherein the return air plenum captures a substantial portion of the air passing through the perforated inspection surface and returns the air to the air filtration housing. The flowhood work station preferably includes at least one ceiling-mounted air vent in proximity to the air filtration housing which supplies air to the flowhood work station, and the air filtration housing substantially encloses the ceiling-mounted air vent.

The present invention has several advantages over the prior art. Because the return air plenum captures a substantial portion of the air passing through the perforated inspection surface and directs the air to the filtration housing, the return air plenum reduces the migration of particles from an operator through the bottom of the perforated inspection surface into the inspection chamber. This also reduces the turbulence at the interface of the inspection chamber and the clean room by minimizing the amount of air deflected from the inspection surface. In addition, the return air plenum allows the air returning to the inspection chamber to be filtered repeatedly and such air is therefore substantially cleaner than the air in the clean room.

The present invention also facilitates vertical laminar air flow in the clean room without turbulence caused by the intake of air from the top of the flowhood work station. By enclosing the ceiling-mounted air vent above the work station, the present invention eliminates the low pressure zone near the top of the work station and reduces the amount of turbulence in the clean room.

The foregoing and other objectives, features, and advantages of the invention will be more readily understood upon consideration of the following detailed description of the invention, taken in conjunction with the accompanying drawings.

DESCRIPTION OF PREFERRED EMBODIMENT

Figure 1:
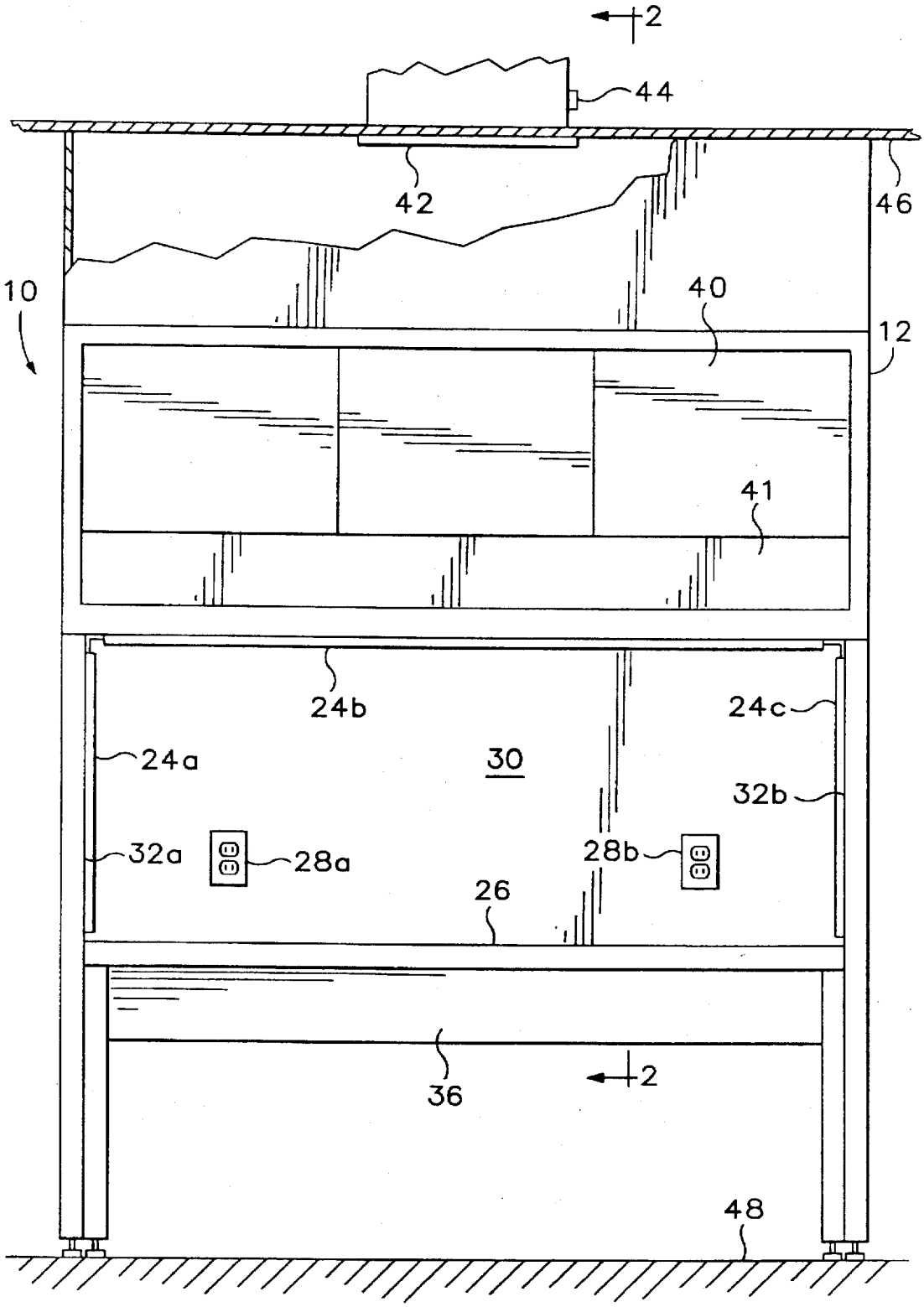
FIG. 1 shows a front elevational view of an exemplary embodiment of a flowhood work station of the present invention.
Figure 2:
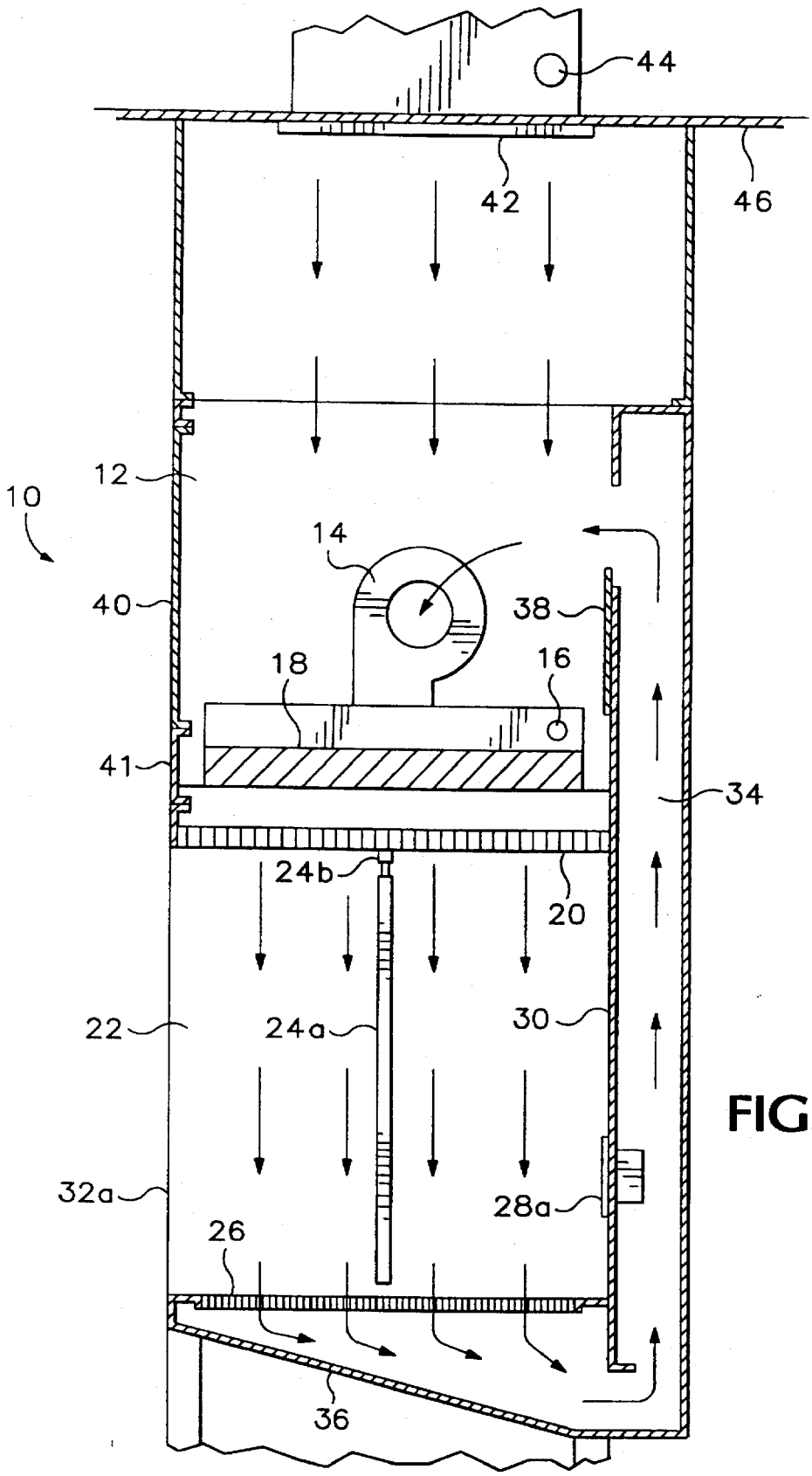
FIG. 2 shows a side sectional view of an exemplary embodiment of the flowhood work station of the present invention along the line 2—2 of FIG. 1.

Referring to the drawings, wherein like numerals refer to the same elements, there is shown in FIGS. 1 and 2 a flowhood work station 10 having an air filtration housing 12. A blower 14 is mounted in the air filtration housing 12 and is capable of directing air downwardly through an ultra-low penetration air (ULPA) filter 18. The blower 14 is capable of producing air velocity of approximately 90 feet per minute.

The ULPA filter 18 is a disposable, rigid-frame, dry filter that has a minimum collection efficiency of 99.999% for particle diameters of ≧0.12 microns (μm) in size. ULPA filter 18 is gasket-sealed using closed-cell foam around its bottom periphery (not shown) to prevent unfiltered air from passing around ULPA filter 18 and into inspection chamber 22.

A pressure differential switch 16 monitors the air pressure above and below ULPA filter 18. If a hole develops in ULPA filter 18, pressure switch 16 detects the pressure change and automatically turns off blower 14 so as to substantially prevent unfiltered air from passing through ULPA filter 18.

After passing through ULPA filter 18, the air passes through a diffuser 20. Diffuser 20 is an egg crate-type black plastic grate. Diffuser 20 aids in creating a uniform vertical laminar flow of air and also protects ULPA filter 18 from accidental physical contact from below.

The air then enters inspection chamber 22 and flows down through perforated inspection surface 26. It is desirable that ULPA filter 18 be placed in close proximity to inspection chamber 22 to provide the greatest possible air pressure in the inspection chamber. Air pressure is greatest immediately adjacent ULPA filter 18 and decreases as the air moves away from the filter. By maintaining a positive air pressure in the inspection chamber 22 relative to the clean room, particles are prevented from entering inspection chamber 22 from the clean room. However, positive air pressure may disturb the vertical laminar flow of air at the interface. It is also desirable that the back wall 30 and side walls **32*a* and 32*b* extend without any gaps to perforated inspection surface 26**, since gaps or perforations may disturb the vertical laminar flow of air, and so contribute to particle contamination.

Inspection chamber 22 may be provided with electrostatic dissipation or discharge devices **24*a*, 24*b* and 24*c* mounted inside, as shown in FIGS. 1 and 2. These devices use ionizers to increase air conductivity, giving particles in the environment a neutral charge. The interior surfaces of the inspection chamber, such as the side walls 32*a* and 32*b*, as shown in FIGS. 1 and 2, back wall 30, and electrostatic dissipation devices 24*a*, 24*b* and 24*c*, are preferably painted flat black with an epoxy paint or some other similar material to absorb as much ambient background light as possible. The absorption of ambient light in inspection chamber 22 aids in the visual inspection of the silicon wafers. The inspection chamber also contains electrical outlets 28*a* and 28*b*** to provide electrical service for a computer or other electrical device in the inspection chamber.

Perforated inspection surface 26 is made from electro-polished stainless steel and is approximately ⅛ inch thick. The perforations in the inspection surface are about ⅛ inch in diameter and occupy approximately 50% of the total surface area of the inspection surface. Because it is critical to avoid metal contamination of the silicon wafers being inspected, it is important that the material selected for inspection surface 26 be resistant to diffusion or generation of metal particles.

After passing through inspection surface 26 the air enters return air plenum 34, which is in fluid communication with perforated inspection surface 26 and with air filtration housing 12. Return air plenum 34 has a bottom surface 36 made from electro-polished stainless steel located beneath inspection surface 26. Bottom surface 36 insulates the operator's lower body from the top of inspection surface 26, thus eliminating the potential for particle contamination from the operator's lower body. Bottom surface 36 may be removable to allow access to return air plenum 34.

Return air plenum 34 captures a substantial portion of the air passing through perforated inspection surface 26 and directs the air to air filtration housing 12, thus preventing air from passing through inspection surface 26 and contacting the lower portion of an operator's body. In operation, return air plenum 34 returns about 80% of the air passing through inspection chamber 22 into air filtration housing 12. Return air plenum 34 also prevents the turbulent flow of air and creation of eddy currents around the operator's body at the interface of the inspection chamber and the clean room, thus reducing particle generation and consequent contamination of the silicon wafer.

A damper 38 is disposed between return air plenum 34 and air filtration housing 12. Damper 38 is adjustable to control the amount of air returned into air filtration housing 12 by return air plenum 34. By using a visual indicator of air flow, such as silk thread or fog, damper 38 may be adjusted to optimize air flow within inspection chamber 22. Thus, damper 38 may be adjusted to maximize the vertical laminar air flow across the interface between the clean room and the inspection chamber 22, and thus minimize air turbulence and eddy currents. Nevertheless, as discussed above, it is desirable to maintain a positive pressure in inspection chamber 22 to prevent contaminants from the clean room from entering the inspection chamber 22.

Return air plenum 34 returns air into air filtration housing 12 above ULPA filter 18 so that the air again passes through the filter 18, effectively creating a closed loop air flow. By constantly recirculating air through ULPA filter 18, the air flowing through inspection chamber 22 is substantially cleaner than the air in the clean room or that found in flowhood work stations of conventional design.

Flowhood work station 10 includes at least one ceiling-mounted air vent 42. The air vent 42 also has an ULPA filter associated therewith. Ceiling-mounted air vent 42 supplies additional air to the flowhood work station, accounting for approximately 20% of the air passing through inspection chamber 22. A second pressure switch 44 may also be included above ceiling-mounted air vent 42 to detect pressure changes which would indicate a breach in or blinding of the ULPA filter in the ceiling-mounted air vent 42.

FIG. 1 shows the flowhood work station 10 situated in a clean room having a ceiling 46 and a floor 48. Air is removed from the clean room through perforations, not shown, in floor 48. Access panel 40 allows the operator to access blower 14 and damper 38. Access panel 41 allows replacement of ULPA filter 18.

Figure 3:
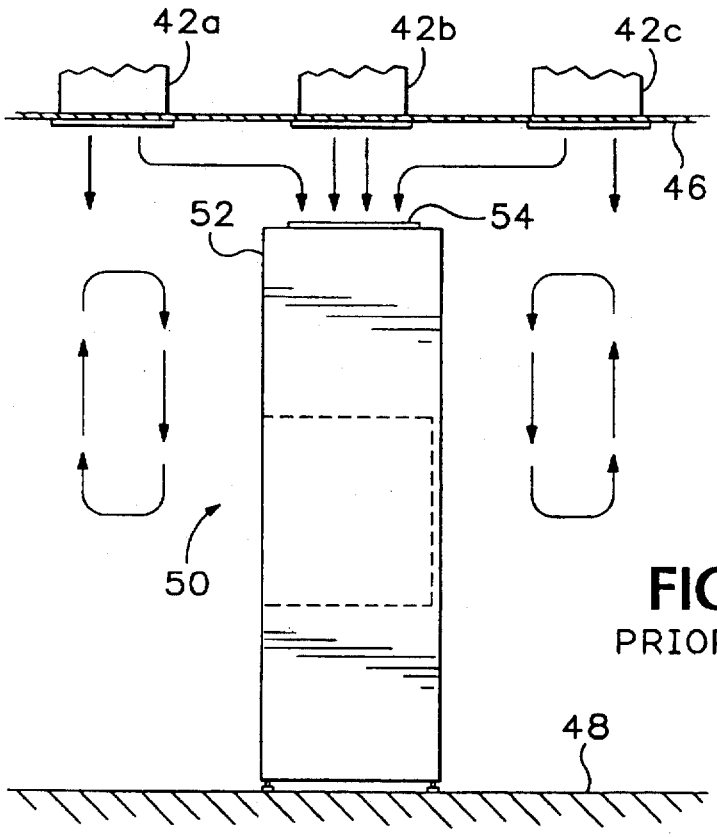
FIG.3 PRIOR ART
FIG. 3 shows a side view of a conventional flowhood work station within a clean room environment.

FIG. 3 shows a conventional work station 50 located within a clean room. Air filtration housing 52 has a top vent 54. Air is drawn into air filtration housing 52 through top vent 54 from ceiling-mounted air vents **42*a*, 42*b* and 42*c*. However, drawing air through the top vent 54 creates low-pressure regions near the top of the conventional flowhood work station 50**. This leads to air turbulence within the clean room as illustrated by the directional arrows.

Figure 4:
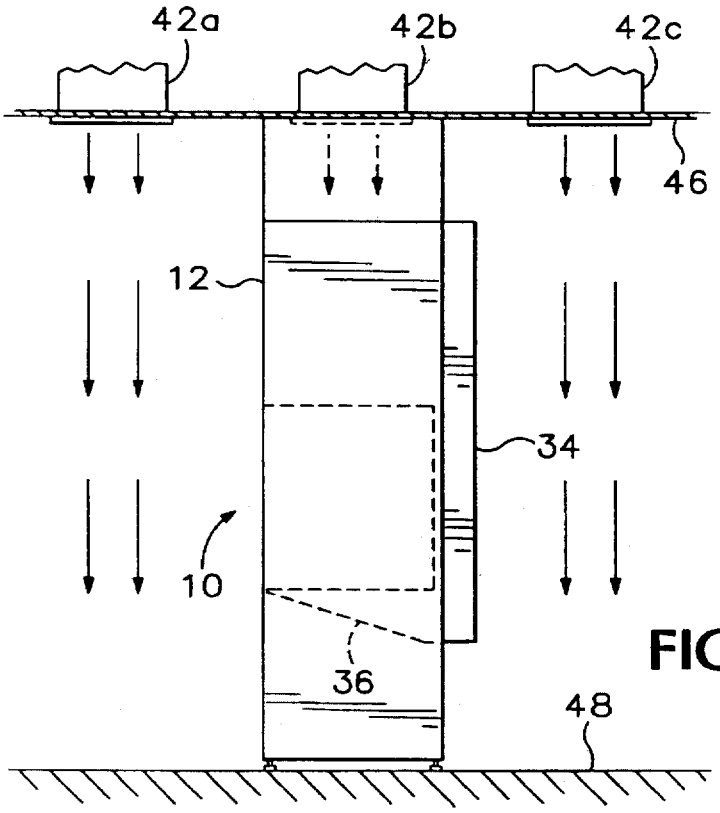
FIG. 4 shows a side view of an exemplary embodiment of the flowhood work station of the present invention in a clean room environment.

FIG. 4 shows air filtration housing 12 of flowhood work station 10 extending to the ceiling 46 of the clean room. By extending air filtration housing 12 to ceiling 46, the low-pressure area caused by the non-vertical flow of air is eliminated. Flowhood work station 10 obtains its supply of additional air directly from ceiling-mounted air vent **42*b*. Thus, the extended air filtration housing 12 of flowhood work station 10 enhances the vertical laminar flow of air in the clean room as indicated by the directional arrows in FIG. 4**.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A flowhood work station in a clean room having a ceiling-mounted air vent, comprising:

(a) an inspection chamber having a vertical back wall and two vertical side walls and a perforated inspection surface, said inspection chamber further defining a front opening opposite said back wall to allow access from said clean room to said perforated inspection surface;

(b) an air filtration housing in fluid communication with said ceiling mounted air vent and said perforated inspection surface;

(c) a blower within said housing capable of directing air downwardly through said perforated inspection surface; and (d) a return air plenum in fluid communication with said perforated inspection surface and with said air filtration housing that captures a substantial portion of said air passing through said perforated inspection surface and directs said air to said air filtration housing.

2. The flowhood work station of claim 1 wherein said air filtration housing substantially encloses said ceiling-mounted air vent.

3. The flowhood work station of claim 1, including a diffuser disposed between said perforated inspection surface and said blower.

4. The flowhood work station of claim 1, including a damper disposed between said return air plenum and said air filtration housing.

5. The flowhood work station of claim 4 wherein said damper is adjustable to control said air directed into said air filtration housing by said return air plenum.

6. The flowhood work station of claim 1 including at least one electrostatic dissipation device within said inspection chamber.

* * * * *